US005566723A

United States Patent [19]

Alexander, III

[11] Patent Number: 5,566,723

[45] **Date of Patent: *Oct. 22, 1996**

[54] APPARATUS AND METHOD FOR GUIDING A TEXTILE WEB OVER A CONVEX GUIDING SURFACE

[75] Inventor: William J. Alexander, III, Mauldin, S.C.

[73] Assignee: Alexander Machinery, Inc., Simpsonville, S.C.

[ * ] Notice: The term of this patent shall not extend beyond the expiration date of Pat. No. 5,431,192.

[21] Appl. No.: 481,050

[22] Filed: Jun. 7, 1995

Related U.S. Application Data

[63] Continuation of Ser. No. 222,233, Apr. 4, 1994, Pat. No. 5,431,192.

[51] Int. Cl.[6] ..... D03D 49/20

[52] U.S. Cl. ..... 139/1 B; 139/291 R; 26/70; 242/538.2; 242/615; 226/196

[58] Field of Search ..... 139/1 B, 304, 139/311, 291 R, 348; 26/70; 242/538.2, 35.5 R, 615, 615.4, 548; 226/196

[56] References Cited

U.S. PATENT DOCUMENTS

| | | | |
|---|---|---|---|
| 2,795,243 | 6/1957 | Strazzeri | 139/291 R |
| 4,234,135 | 11/1980 | Conner, Jr. | 26/70 |
| 4,387,590 | 6/1983 | Alexander, III | 26/70 |
| 4,430,012 | 2/1984 | Kooy et al. | 242/615 X |
| 4,593,725 | 6/1986 | Alexander, III | 139/304 |
| 4,619,295 | 10/1986 | Alexander | 242/35.5 RX |
| 4,702,283 | 10/1987 | Shaw | 139/304 |
| 4,826,128 | 5/1989 | Schmeller | 384/54 X |
| 5,431,192 | 7/1995 | Alexander, III | 139/1 B |
| 5,456,292 | 10/1995 | Alexander, III | 242/538.2 |

FOREIGN PATENT DOCUMENTS

| | | | |
|---|---|---|---|
| 1409994 | 7/1965 | France | 26/70 |

*Primary Examiner*—Andy Falik
*Attorney, Agent, or Firm*—Ralph Bailey

[57] ABSTRACT

An apparatus and method for guiding a web utilizes a curved outer convex cloth guiding surface constructed of extruded aluminum with a specially hardened, brittle, wear resistant surface (A) on arcuate sections such as extrusions provided respectively at the top and bottom of the viewing area for guiding cloth and for forming a housing for the light box wherein an inner housing surface (B) is provided opposite the cloth guiding surface (A) on each extrusion. Depending receiving members (C) are provided at each respective end of the arcuate extrusions for serving as a receptacle for guiding and positioning a plexiglass viewing member and back sheet metal wall for forming a light box. A force applying member (D) is provided for controlling sag or bow in an extrusion. Apparatus and method is illustrated including diverging grooves for spreading the web as it passes over the upper section, and circuitry is provided conserving energy by limiting the time the circuitry is energized.

5 Claims, 5 Drawing Sheets

APPARATUS AND METHOD FOR GUIDING A TEXTILE WEB OVER A CONVEX GUIDING SURFACE

This is a Continuation of my application Ser. No. 08/222,233, entitled WEB INSPECTION APPARATUS AND METHOD, filed Apr. 4, 1994 U.S. Pat. No. 5,431,192.

BACKGROUND OF THE INVENTION

This invention relates to guiding apparatus and method which is especially useful for guiding a web such as cloth manufactured upon a textile machine.

Cloth inspection devices as used, for example, on looms often employ rotatable rolls over which the cloth passes prior to inspection adjacent the bottom of a light box with another rotatable roll at the top of the light box as illustrated in U.S. Pat. No. 4,619,295 and in the prior art illustrated herein. Such inspection apparatus has considerable height due to the necessity for positioning the rolls above and below the inspection area of the light box and the like. Moreover, such structures provide a limited viewing area and are relatively expensive, requiring considerable maintenance for their operation.

Efforts to solve the problems have included the provision of a light box having a low profile such as illustrated in U.S. Pat. No. 4,593,725. Such devices have the disadvantage of providing only a limited inspection area since such is effectively divided or split extending on both sides of the takeup.

Accordingly, it is an important object of this invention to provide an improved web inspection apparatus and method which may be inexpensively manufactured and operated while providing a low profile conserving space in the loom area of the mill.

While the invention is illustrated as being applied to a loom, such may be used in other textile fabric manufacturing and winding machines as well as in plastic or other web forming or winding applications.

SUMMARY OF THE INVENTION

An important object of the invention is the provision of apparatus and method for guiding a textile web utilizing a curved outer convex guiding surface constructed of aluminum with a hardened, brittle, wear resistant surface engaging the web to effect a change in direction of the web with reduced wear.

Accordingly, the invention contemplates utilizing an extruded guide member at least at the top of a light box providing a convex cloth guiding surface on the top for permitting the web to pass thereover without the necessity for moving parts while at the same time lowering the profile of the light box or table.

Another important object of the invention is to provide a light box having an extrusion curved at its outer portion to guide the passage of cloth and the like while providing an inner side which forms the top of a light box which readily accommodates front and back members wherein the front member is plexiglass and the like permitting the ready transmission of light and an enlarged viewing area.

Another important object of the invention is to provide a light box having a pair of opposed arcuate stationary extruded members wherein outer convex surfaces are provided for guiding a web at the top and at the bottom while opposite inner surfaces constitute upper and lower portions of a light box providing depending fastening or receiving members for positioning front and back members completing the light box housing for spaced fluorescent tubes and the like and for providing a viewing area.

Another important object of the invention is the provision of an elongated inspection apparatus capable of accommodating webs spaced longitudinally thereof passing over a lower concave surface and thence over a curved outer convex cloth guiding surface on an extrusion positioned at the top of the light box wherein a mechanical means is provided for maintaining an upwardly directed force upon the upper extrusion for maintaining a desired amount of bow or concavity throughout the length of the extrusion which otherwise tends to deflect or to sag in the middle due to its weight in relation to its length.

Another object of the invention is the provision of a structural support for the upper extrusion wherein a centrally, mounted threaded member is carried thereby for exerting a threadable adjustable force tending to bow the extrusion upwardly.

Still another object of the invention is the provision of apparatus for conserving energy by automatically limiting the on time of the lights of the inspection while making switching apparatus readily accessible to the operators.

Another object of the invention is the provision of cloth spreading means for opening the cloth as it passes over the inspection apparatus.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 7-A is a transverse sectional elevation illustrating a modified form of the invention.

DESCRIPTION OF A PREFERRED EMBODIMENT

The drawings illustrate apparatus for inspecting and guiding a web thereover in open width including an enclosure or light box containing a source of light. The enclosure has an outwardly curved stationary extrusion over which the web is guided in relation to the source of light. The extrusion presents a curved outer convex cloth guiding surface A. A concave inner housing B is formed by the extrusion opposite the curved cloth guiding surface. Receiving members C are positioned on each end of the extrusion for carrying the enclosure forming front and back members on upper ends of the respective members. At least one of the members is transparent permitting passage of light from within the enclosure through the web facilitating inspection thereof. Thus, a low profile inspection apparatus is provided wherein the extrusion serves as a guide for the web as well as an enclosure forming member.

Figure 1:
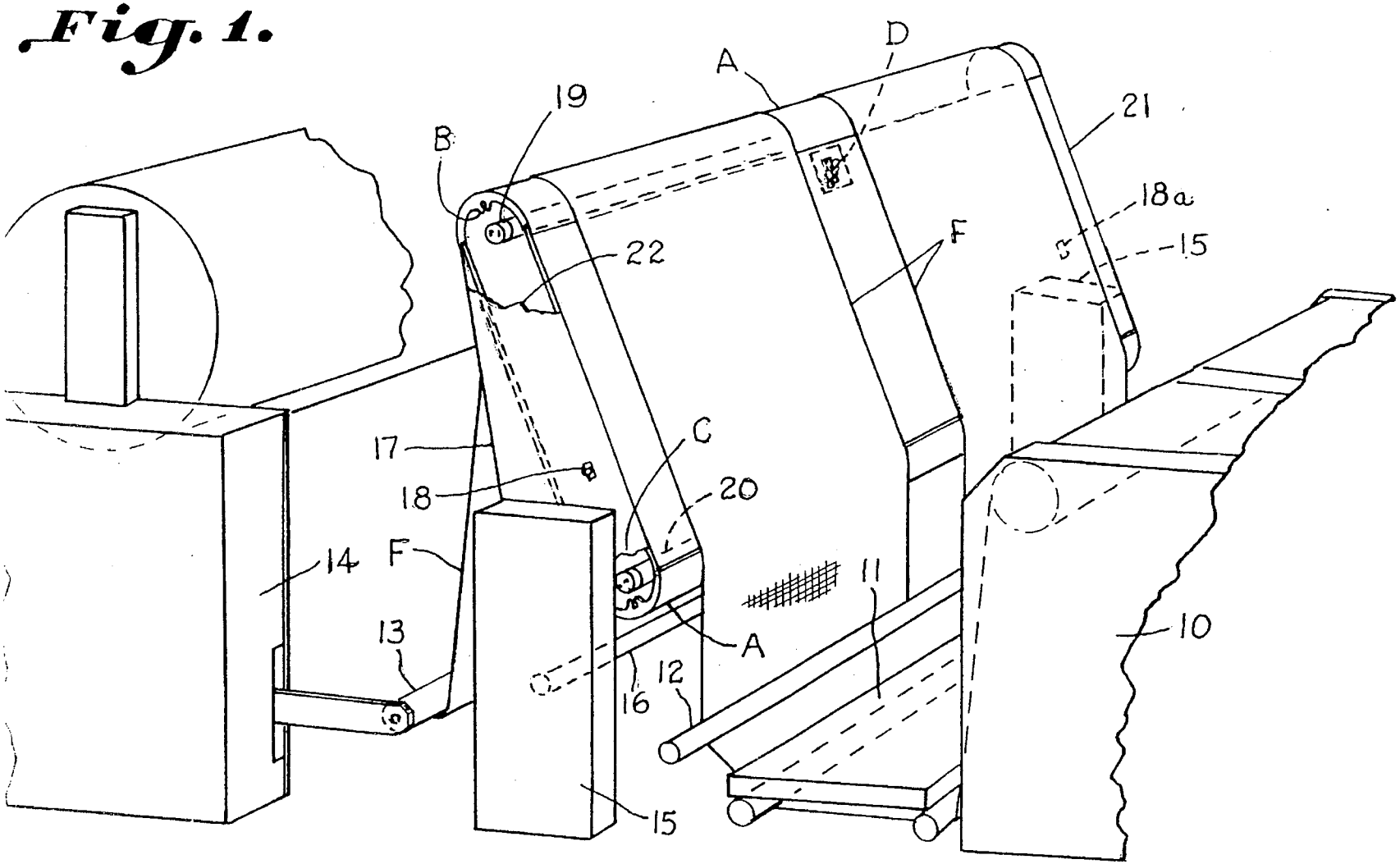
FIG. 1 is a perspective view illustrating an apparatus for inspecting cloth manufactured on a loom constructed in accordance with the invention wherein a pair of webs spaced longitudinally of the inspection device are illustrated as passing over a lower or first outwardly curved surface of a first or lower structural section, preferably an extrusion and thence over a light box constituted on the bottom by the extrusion and on the top by a second complementary structural section or extrusion over which the cloth passes prior to being directed to a takeup or other suitable means of handling the cloth.

Referring more particularly to FIG. 1, a pair of spaced fabric webs as may be manufactured upon a loom, each designated at F, are fed from a loom 10, beneath an operator's platform, beneath a stationary guide roll 12 and thence upwardly toward a lower extrusion which presents a first outwardly curved convex cloth guiding surface A. The cloth passes thence in front of the viewing area represented in this case by the light box and over a second curved outer convex cloth surface A on an upper extrusion. The webs F pass thence in a downward run over a guide member such as a compensator roll 13 at the rear of the inspection machine for controlling tension in the web preparatory to being received by a takeup or other disposition means for the fabric as further illustrated for example in U.S. Pat. No. 4,216,804. The inspection apparatus is illustrated in FIG. 1 as including a frame which has vertical spaced members 15 carried at each end thereof. The frame members 14 and 15 are bridged by a stationary support roll 16 and other suitable frame members, such as the vertical frame member 17, as desired to provide sufficient rigidity.

The inspection apparatus of FIG. 1 includes left and right hand switches 18 and 18a for turning the light on and off in the light box from either end of the platform 11. In this case the source of light may be a pair of fluorescent tubes 19 and 20 which may be carried by a suitable end support 21 providing ballast (not shown) and other necessary components for properly supporting and operating the fluorescent tubes. A similar end support 22 is provided at an opposite end of the apparatus carrying the light switch 18, and a plexiglass member 23 is provided to emit light for passage through the webs F.

Figure 2:
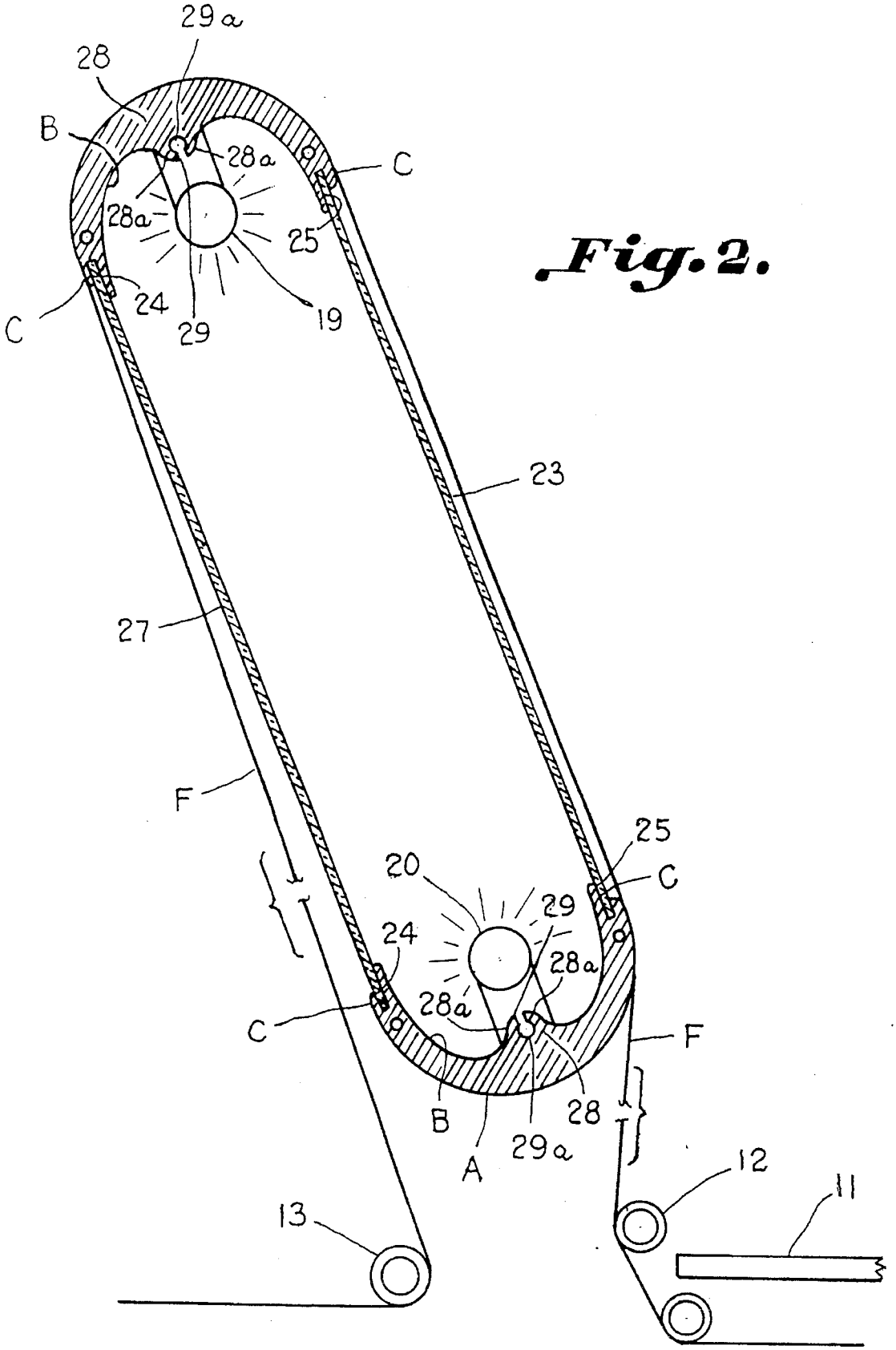
FIG. 2 is an enlarged transverse sectional elevation illustrating the cross sectional configurations of the extrusions forming the upper and lower cloth handling extremities of the light box.

Referring more particularly to FIG. 2, it will be observed that the extrusions in addition to providing the outer convex cloth guiding surfaces A, provide inner housing surfaces B opposite thereto and form an inner housing of the light box formed having depending receiving members C on each end thereof. The receiving members C each include grooves opposed 24 and 25 for positioning front plexiglass members 23 and back member 27 respectively. The upper and lower extrusions have a thickened central portion 28 which extend inwardly including spaced arcuate opposed fingers 28*a* defining a slot 29 therebetween opening into a layer receptacle 29*a*. The thickened central portion provides increased structural strength avoiding excessive deflection, serves to receive fasteners (not shown) for securing the end supports 21 and 22 and may position tube sockets and conductors in any suitable manner (not shown).

In the embodiment shown in FIG. 2, the back member 27 is illustrated as being a rectangular sheet metal member, while the front member 23 is illustrated as being plexiglass and transparent for providing a viewing area at the front of the inspection apparatus. If desired, the back member may also be constructed of plexiglass for providing an additional viewing area.

Figure 3:
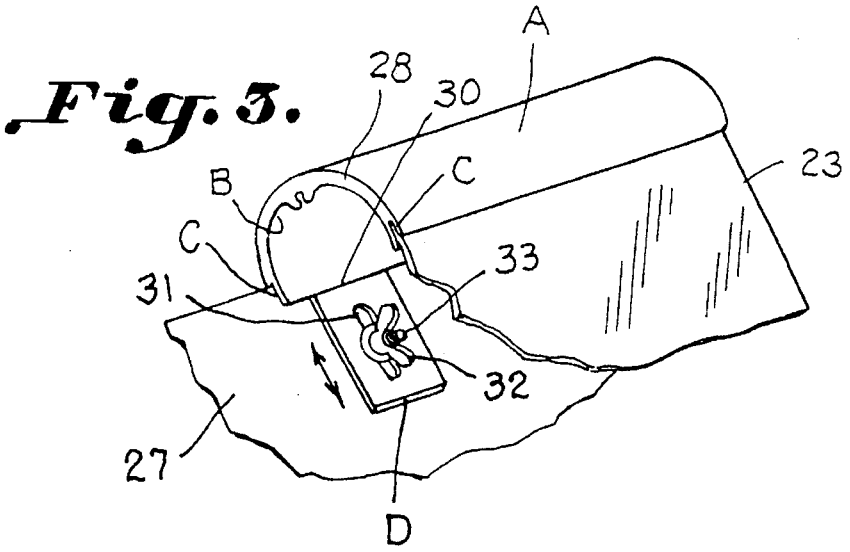
FIG. 3 is an enlarged perspective view illustrating a force applying member disposed adjacent an intermediate portion of the upper extrusion for exerting a force which may tend to overcome the tendency of the extrusion to deflect due to its weight and the action of the web passing thereover.

FIG. 3 illustrates a force applying member which may be carried by the metallic sheet 27 at an intermediate portion, preferably in the central portion, of the top as illustrated at D in FIG. 3. Preferably, the force applying member D is rectangular so as to provide an upper edge 30 for exerting a force upwardly against the upper extrusion. A slot 31 in the rectangular force applying member accommodates a threadable member such as a thumb screw 32 which is carried upon a threaded shank 33 in fixed relation upon the sheet metal backing member 27. The force applying member is calculated to overcome any tendency of the upper cloth guide extrusion to sag as a result of its weight and the force exerted thereon by the webs passing thereover. Such a member may not be necessary if the span is shorter such as when only a single web is being utilized or provided for.

Figure 4:
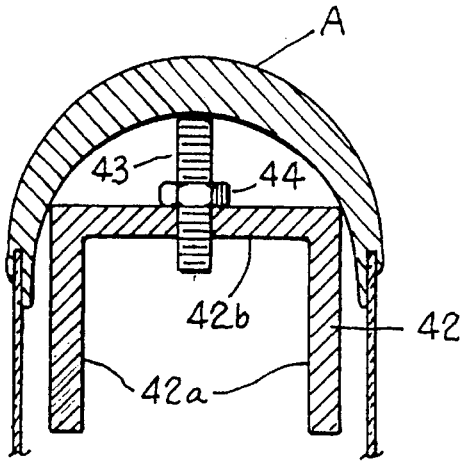
FIG. 4 is a side elevational view illustrating a modified form of the invention wherein a channel shaped structural member with downturned flanges installed beneath an upper extrusion support the extrusion upon an upper web of the structural member.

The modified form of the invention illustrated in FIG. 4 includes an inverted channel 42 having downturned flanges 42*a* bridged by a web member 42*b*. The structural insert in the form of the channel 42 may be designed to supplement the strength of the extrusion to prevent excessive deflection, and, if desired, a threaded member 43 may be carried in the internally threaded nut 44 to project upwardly to exert an adjustable upward force upon a central portion of the extrusion to prevent deflection or provide an upward bow in the cloth guiding surface A. Such a construction is particularly useful upon a wide loom wherein long unsupported extrusion lengths are necessitated.

Figure 5:
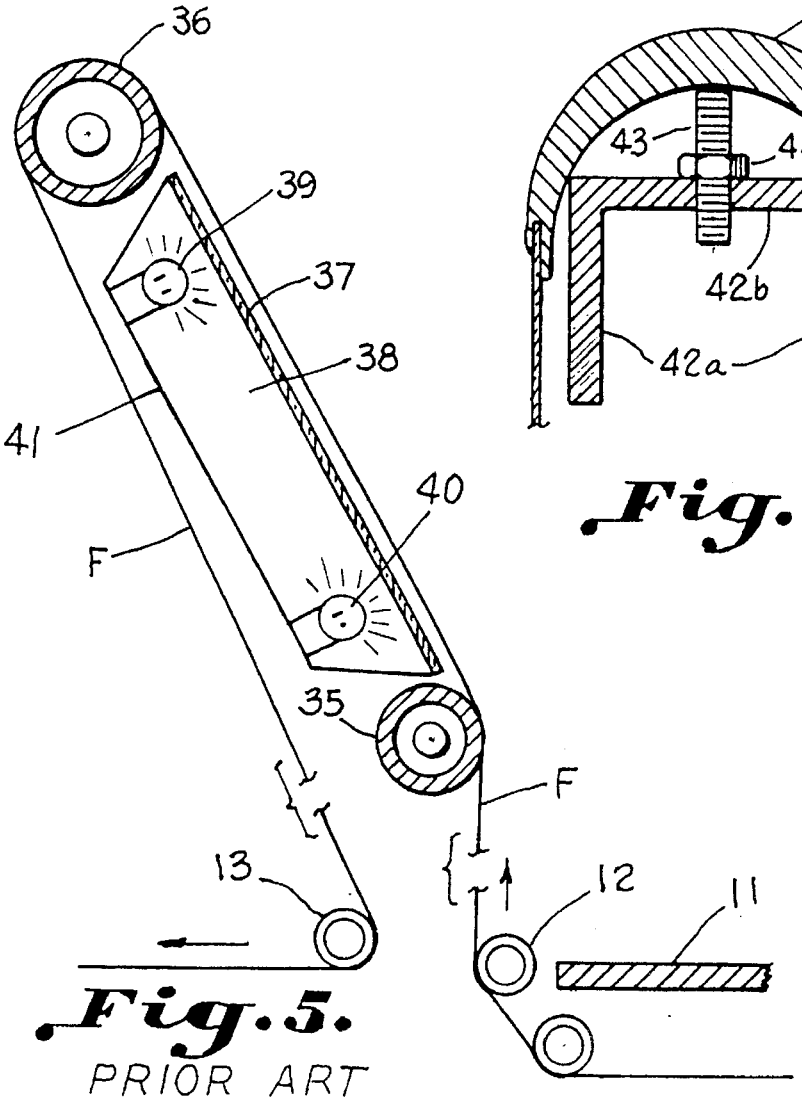
Fig. 5. PRIOR ART
FIG. 5 is an end view illustrating a web inspection box constructed in accordance with the prior art wherein upper and lower rotatably mounted rolls are illustrated as are conventionally provided to guide and direct the web over a viewing side of a light box.
Figure 7A:
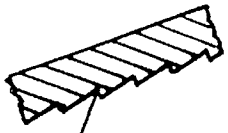
FIG. 7 is a transverse sectional elevation taken on the line 7—7 in FIG. 6.

FIG. 5 illustrates a light box constructed in accordance with the prior art wherein rolls including a lower roll 35 and an upper roll 36 are positioned below and above the light box respectively for receiving cloth webs F. A plexiglass front cover is illustrated at 37 and a housing 38 carries a pair of fluorescent tubes 39 and 40. A suitable sheet metal backing member may be provided as at 41.

The extrusions described in the preferred embodiment of the invention illustrated herein are preferably constructed of aluminum with a specially hardened surface so as to be capable of withstanding the wear caused by the friction resulting from fabric passing continuously thereover over extended periods of time. Such hard brittle but wear resistant surfaces are available in many types of available treatment for aluminum extrusions and the like.

Figure 6:
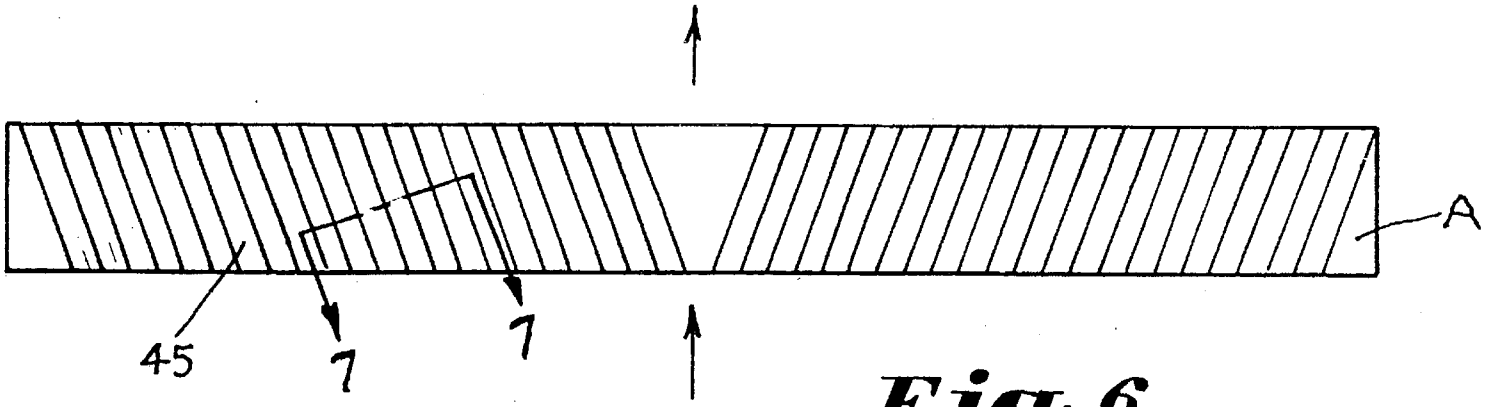
FIG. 6 is a top plan view illustrating means for spreading the cloth as it is moved over the arcuate surface of the upper section which includes serrations which diverge in the direction of cloth travel as illustrated by the arrows.
Figure 7:
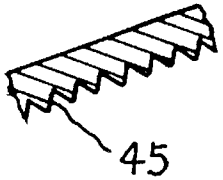
Figure 8:
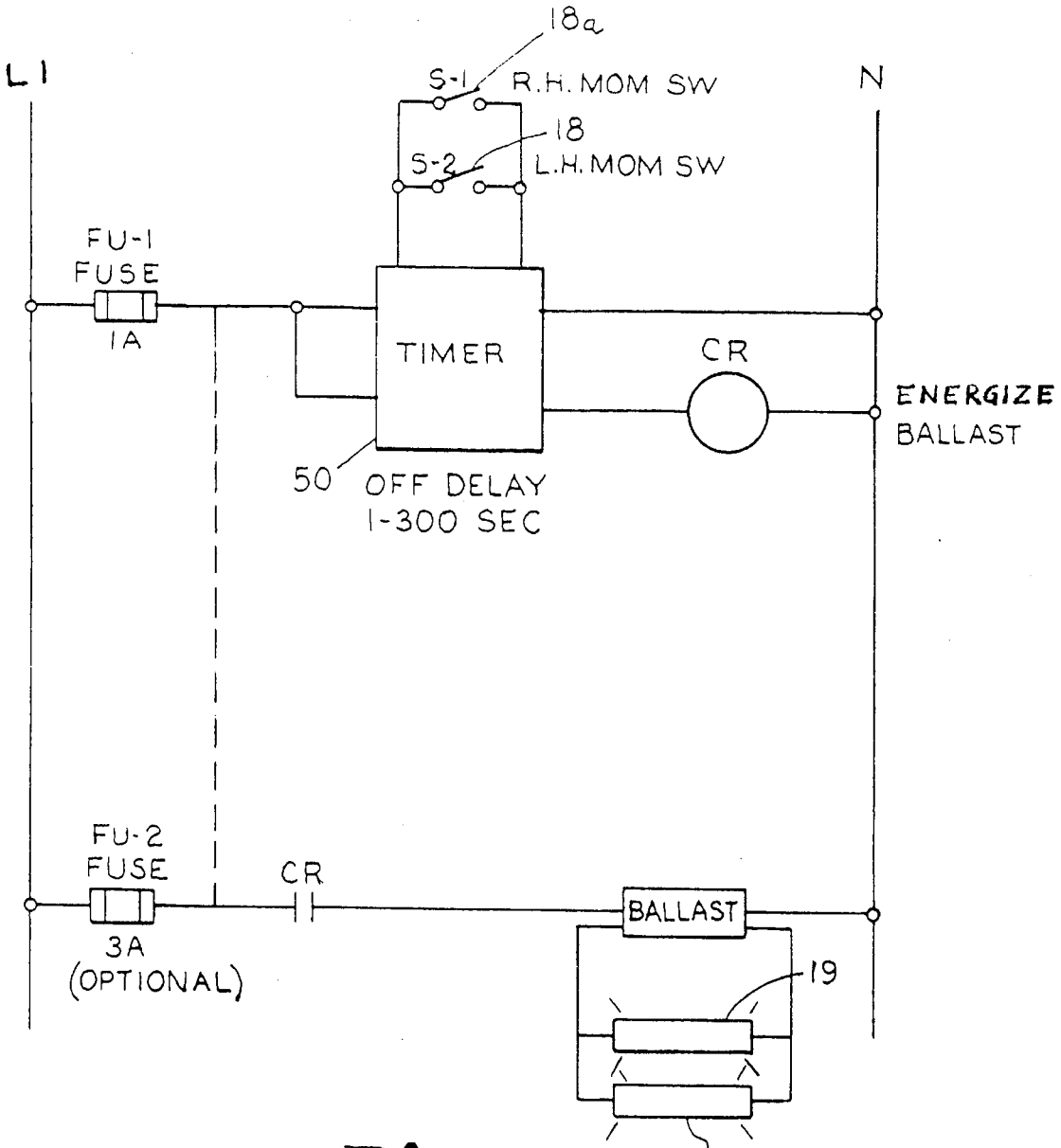
FIG. 8 is a circuit diagram illustrating the electrical components of apparatus for conserving energy.

FIG. 6 illustrates diverging serrations or grooves in the upper surface A for spreading the fabric as it moves over the inspection apparatus. FIG. 7 illustrates symmetrical saw tooth grooves 45 for spreading the web. FIG. 7-A illustrates a modified form of the invention wherein serrations include grooves having a vertical leg 46 on one side to enhance spreading action. Preferably, the grooves or serrations may be machined or placed on the surface A of an extrusion. The section may be vacuum formed or otherwise molded. The grooves diverge as positioned on respective sides of said section.

FIG. 7 illustrates apparatus and method utilizing a lamp timer circuit for providing an automatic off cycle for energy management. Switches S-1d2 are both momentary contact switches.

The circuitry permits an operator to enter the lightbox area from the right or left hand side of the platform 11. Switches S-1 (18*a*) or S-2 (18) are actuated to turn the lightbox on. After the operator leaves the lightbox, the timer 50 (which is an off-delay) automatically times out and drops the relay CR out which in turn, de-energizes the lightbox ballast for operating the lamps 39 and 40.

It is thus seen that an improved light box has been provided wherein curved surfaces, which are integral with housing forming members, are provided for guiding the fabric at the bottom and at the top of the viewing area and for positioning front and back light box forming members. Light boxes constructed in this fashion provide a low profile and are relatively maintenance free over long periods of time. Cloth guiding and spreading apparatus may be included as well as apparatus for conserving energy.

While a preferred embodiment of the invention has been described using specific terms, such description is for illustrative purposes only, and it is to be understood that changes and variations may be made without departing from the spirit or scope of the following claims.

What is claimed is:

1. Apparatus for guiding a textile web received from a source of web material in open width for winding upon a take-up roll comprising:

means directing a textile web at a first angle in open width toward a textile web guiding surface for changing the direction of the web;

a stationary outwardly curved extruded aluminum section over which said textile web is carried in a predetermined wrap;

a fixed support at each end of said section for mounting said section in stationary relation thereto between said source and said take-up roll;

a curved outer convex textile web guiding surface on said section consisting of said aluminum with a hardened, brittle, wear resistant surface engaging said textile web received thereover; and means directing said textile web at a second angle away from said wear resistant surface;

whereby said extruded aluminum section serves as a guide for changing the direction of the textile web while minimizing wear.

2. The apparatus set forth in claim 1 including reinforcing means supporting said extruded aluminum section intermediate its ends.

3. The apparatus set forth in claim 1 wherein said extruded aluminum section guides said textile web over a textile web inspection area.

4. The method of guiding a web received in open width comprising the steps of:

tensioning and moving a web under controlled tension;

directing a said web under said controlled tension at a first angle in open width toward a web guiding surface;

mounting a stationary outwardly curved extruded aluminum section for receiving said web thereover under said controlled tension for changing direction of the web;

providing a curved outer convex web guiding surface on said section constructed of aluminum with a hardened, wear resistant guiding surface engaging said web received thereover with a predetermined wrap; and directing said web at a second angle away from said wear resistant guiding surface under said controlled tension;

whereby said section serves as a guide for the web while minimizing wear.

5. Apparatus for inspecting a web passing thereover in open width comprising:

an enclosure containing a source of light over which said web is carried for inspection;

said enclosure including;

an outwardly curved section constructed of extruded aluminum forming an end of said enclosure;

a stationary curved outer convex hardened wear resistant surface on said section;

a concave inner housing surface formed by said section on a side opposite said convex surface;

means on each end of said section for positioning enclosure forming side members; and at least one of said side members being transparent permitting passage of light from within the enclosure through the web facilitating inspection thereof.

* * * * *